US006257710B1

(12) United States Patent
Haigo

(10) Patent No.: US 6,257,710 B1
(45) Date of Patent: Jul. 10, 2001

(54) PACKAGE FOR INK CARTRIDGE AND METHOD FOR MANUFACTURING THE SAME

(75) Inventor: Hideaki Haigo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/042,993

(22) Filed: Mar. 17, 1998

(30) Foreign Application Priority Data

Mar. 17, 1997 (JP) ..... 9-063377

(51) Int. Cl.[7] ..... B41J 2/17
(52) U.S. Cl. ..... 347/84
(58) Field of Search ..... 347/84, 85, 86, 347/87; 206/701, 522

(56) References Cited

U.S. PATENT DOCUMENTS 5,701,995 * 12/1997 Higuma et al. ..... 206/205
5,857,571 * 1/1999 Tschantz et al. ..... 206/522
5,953,030 * 9/1999 Ishinaga et al. ..... 347/86

* cited by examiner

*Primary Examiner*—N. Le
*Assistant Examiner*—Michael Nghiem
(74) *Attorney, Agent, or Firm*—Oliff & Berridge, PLC

(57) ABSTRACT

An ink-cartridge package includes a packaging bag. The packaging bag has a maximum packaging volume $V_{max}$ which is smaller than or equal to twice a volume $V_i$ of an ink cartridge to be packed ($V_{max}$ $2V_i$). When the ink cartridge is packed in the packaging bag, the packaging bag contains a volume of air that is 10% to 30% of the volume of the ink cartridge. The air contained in the packaging bag operates as an air cushion, which can efficiently prevent the ink cartridge from cracking or breaking due to impacts even if no shock absorber is inserted between the ink cartridge and the packaging bag. The packaging bag can be folded at the edge portions so as to be easily transported. Since no extra materials or extra steps are required, the cost of manufacturing the ink-cartridge package is relatively low.

11 Claims, 8 Drawing Sheets

Fig. 7

| THE RATIO S(%) OF THE VOLUME OF AIR LAYER TO THE VOLUME OF INK CARTRIDGE IN PACKAGING BAG | PERCENTAGE OF BREAKAGE OF INK CARTRIDGE OR PACKAGING BAG |
|---|---|
| LESS THAN 10 % | 80 % |
| 10 % TO 30 % | 10 % |

PACKAGE FOR INK CARTRIDGE AND METHOD FOR MANUFACTURING THE SAME

BACKGROUND OF THE INVENTION

1. Field of the Invention

This invention relates to a package for ink cartridges used in, for example, ink-jet printers, and a method for manufacturing such as package.

2. Description of the Related Art

Ink cartridges used in ink-jet printers are packaged at the end of the manufacturing process. Generally, ink cartridges are vacuum-packed in a series of packaging bags. The packaging bags include an ink-cartridge package. Each packaging bag sticks to the ink cartridge contained therein.

However, because the conventional packaging bag sticks to the outer surface of the ink cartridge, external vibration easily propagates to the ink cartridge. For example, if the ink-cartridge package is dropped or moved violently during shipping or transportation, the ink cartridges that are packed in the package are likely to crack or break, and the packaging bag itself may tear.

In order to protect the ink cartridge and the packaging bag from an impact, a shock absorbing material is inserted between the ink cartridge and the packaging bag. However, inserting the shock absorbing material creates extra costs and steps, which increases the manufacturing cost as a whole.

SUMMARY OF THE INVENTION

Therefore, it is an object of the invention to provide a package for an ink cartridge, which can directly package the ink cartridge while protecting the ink cartridge from impacts or vibrations. It is another object of the invention to provide a method for manufacturing such an ink-cartridge package without increasing the manufacturing cost.

In accordance with one aspect of the invention, an ink-cartridge package comprises a packaging bag for packaging an ink cartridge. The ink cartridge includes a cartridge case and ink contained in the cartridge case. As the feature of this package, the maximum packaging volume of the packaging bag is set to be less than or equal to 200% of the volume of the ink cartridge to be packed. When the ink cartridge is packed in the packaging bag, the packaging bag contains air. The volume of the air is 10% or more of the volume of the ink cartridge.

Unlike the conventional vacuum packing, the invention includes the air layer having a volume of 10% or more of the volume of the ink cartridge. The air layer is formed between the packaging bag and the ink cartridge. The air layer operates as an air cushion to protect the ink cartridge from impacts to prevent the ink cartridge from cracking or breaking. This structure obviates the insertion of an extra shock absorber in the packaging bag.

If the volume of the air contained in the packaging bag is less than 10% of the volume of the ink cartridge, the packaged state approaches vacuum packing, and the air layer does not operate as an air cushion. Preferably, the maximum packaging volume of the packaging bag is 140% to 160% of the volume of the ink cartridge, and air having a volume of between 10% to 30% of the volume of the ink cartridge is contained in the packaging bag when the ink cartridge is packed.

If the maximum packaging volume is below 140% of the volume of the ink cartridge, the packaging bag cannot contain a sufficient amount of air to absorb shocks after the ink cartridge is packed. If the maximum packaging volume exceeds 160% of the volume of the ink cartridge, the packaging volume is too large as compared with the volume of the ink cartridge to be packed, and the surface of the packaging bag may lose tension and thus be unable to form an appropriate air layer between the ink cartridge and the packaging bag.

If the volume of air contained in the packaging bag exceeds 30% of the volume of the ink cartridge, the ink cartridge is apt to move within the packaging bag. In this case, the shock absorbing ability cannot be satisfactorily achieved, and the packaging bag may burst due to impact.

In addition, the excessive amount of air may cause the ink contained in the ink cartridge to deteriorate. In general, ink cartridges are shipped after they are packed in a series of packaging bags, as shown in FIG. 6. If the air contained in each packaging bag is excessive, the packaging bags cannot be folded at their respective boundaries, which causes problems in shipping and transportation.

As discussed above, the preferred amount of air contained in the packaging bag is 10% to 30% of the volume of the ink cartridge. In this range, the series of packaging bags that contain the ink cartridges can be folded and accommodated in a box for shipping and transportation.

The packaging bag is made of, for example, aluminum laminate. Alternatively, the packaging bag does not have to be made of aluminum. Basically, the packaging bag can be made of any suitable resin. The shape of the packaging bag is, for example, a flat bag having edges that are thermally sealed, a cylindrical pillow case, and a gusset bag having a gore.

The ink cartridge that is packed in this package is used, for example, in ink-jet printers.

A notch may be formed in the thermally sealed edge of the packaging bag in order to allow the user to easily open the packaging bag.

In accordance with another aspect of the invention, an ink-cartridge package comprises a packaging bag for packaging an ink cartridge. The packaging bag is thermally sealed in a thermal-sealing box under the following condition:

$$10 \leqq [(Vr/Vi)-1] \times (Pr/Po) \times 100 \leqq 30,$$

where Vr is the packaging volume of the packaging bag, Vi is the volume of the ink cartridge to be packed in the packaging bag, Pr is the pressure within the thermal-sealing box, and Po is the atmospheric pressure.

In accordance with still another aspect of the invention, a method for manufacturing an ink-cartridge package is provided. In this method, a packaging bag is formed by aligning two rectangular sheets and thermally sealing three edges of the aligned rectangular sheets, while leaving one edge unsealed in order to form an open edge. Then, an ink-cartridge is inserted into the packaging bag from the open edge of the packaging bag. The open edge of the packaging bag is inserted in a thermal-sealing box, and is thermally sealed up. The pressure in the thermal-sealing box is adjusted so as to satisfy the following condition:

$$10 \leqq [(Vr/Vi)-1] \times (Pr/Po) \times 100 \leqq 30.$$

This method may further comprise the step of forming an opening notch in the packaging bag.

BRIEF DESCRIPTION OF THE DRAWINGS

A preferred embodiment of the invention will be described in detail with reference to the attached drawings wherein:

FIG. 7 shows test results of dropping the ink-cartridge package of the invention;

DETAILED DESCRIPTION OF THE PREFERRED EMBODIMENTS

The preferred embodiments of the invention will now be described with reference to the attached drawings.

Figure 1:
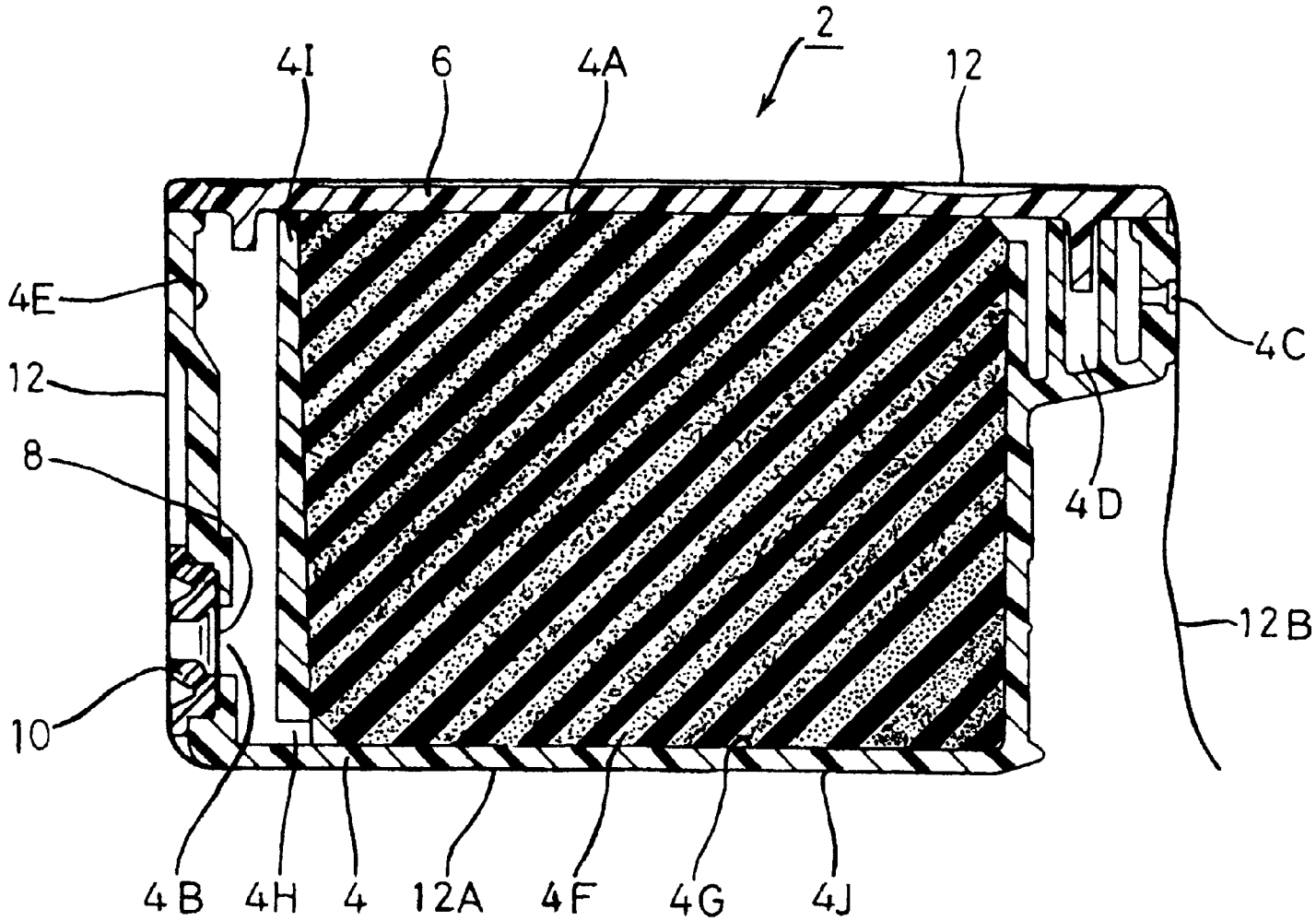
FIG. 1 is a vertical cross-sectional view of an example of an ink cartridge.

FIG. 1 is a cross-sectional view of an example of an ink cartridge 2. The ink cartridge 2 is used in ink-jet printers which perform a printing operation by ejecting ink drops onto a recording medium. The ink cartridge 2 has a parallelepiped cartridge case 4 having an opening 4A in the top wall. The opening 4A is covered with a lid 6.

Figure 2:
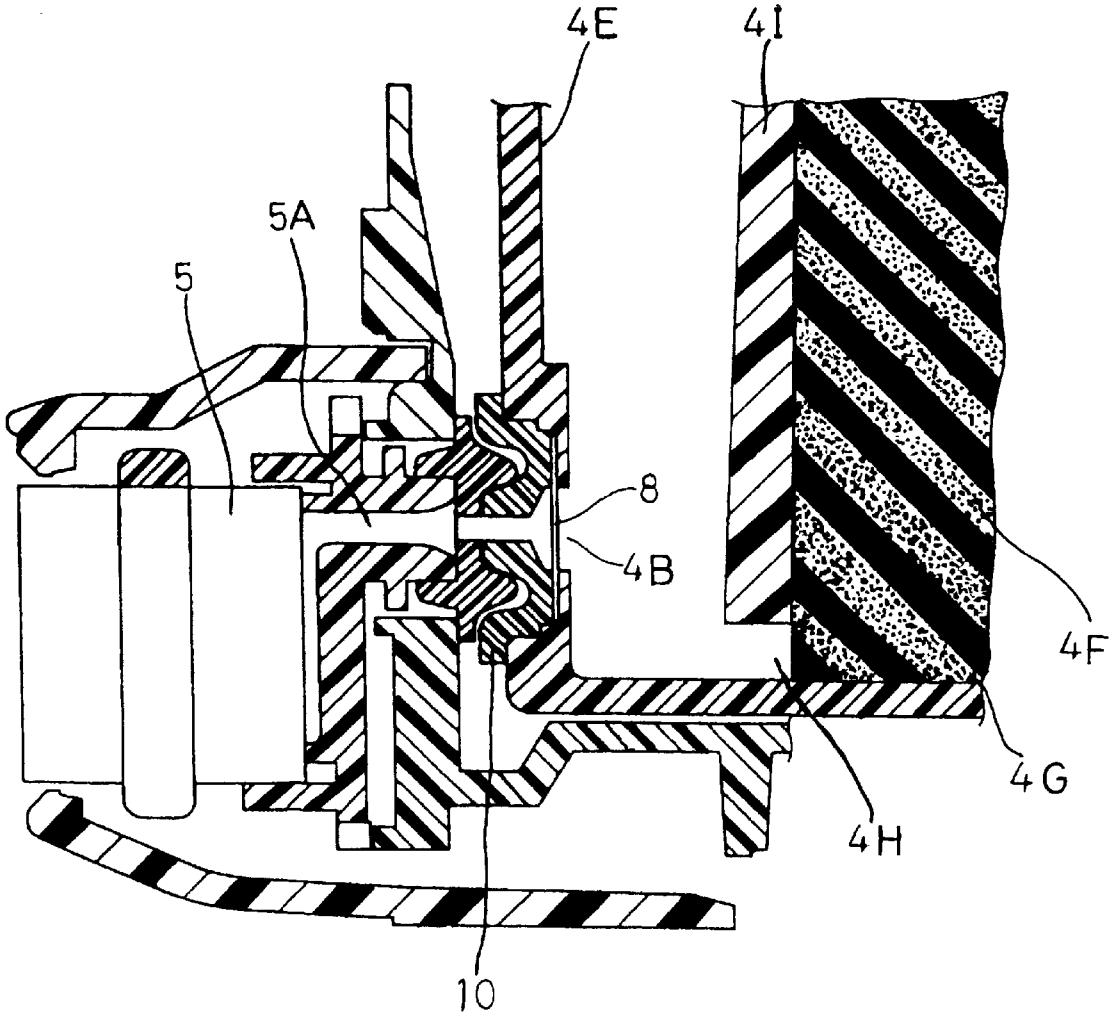
FIG. 2 is an enlarged cross-sectional side view showing how the ink cartridge shown in FIG. 1 is set into an ink-jet printer.

FIG. 2 is an enlarged side view of a portion of the ink cartridge 2. The ink cartridge case 4 has an ink-supply hole 4B at its side wall. When the ink cartridge 4 is set into an ink-jet printer, ink is supplied to the manifold 5A of the ink-jet recording head 5 through the ink-supply hole 4B. An air hole 4C is formed at the other side wall of the cartridge case 4. An air buffer 4D is formed inside the side wall at a position corresponding to the air hole 4C in order to prevent the ink from evaporating via the air hole 4C.

The cartridge case 4 has an ink chamber 4E that communicates with the ink-supply hole 4B, and a foam chamber 4G located next to the air hole 4C. The foam chamber 4G is filled with a porous material 4F (e.g., foam urethane resin) for absorbing ink. The ink chamber 4E and the foam chamber 4G are connected to each other via a hole 4H formed near the bottom of the cartridge case 4.

The ink-supply hole 4B is provided with a mesh filter 8 for removing dust or undesired particles from the ink that is supplied to the recording head 5. An adapter 10 is also provided to the ink-supply hole to connect the ink cartridge 2 to the recording head 5.

Figure 3A:
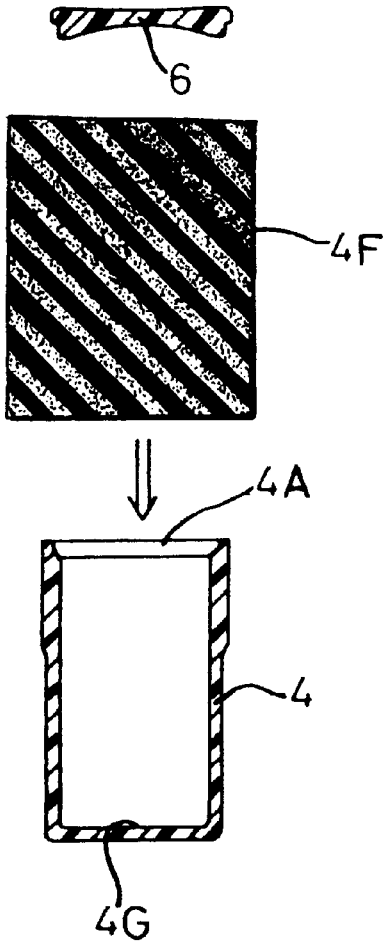
FIGS. 3A and 3B illustrate a portion of the manufacturing process of the ink cartridge shown in FIG. 1.
Figure 3B:
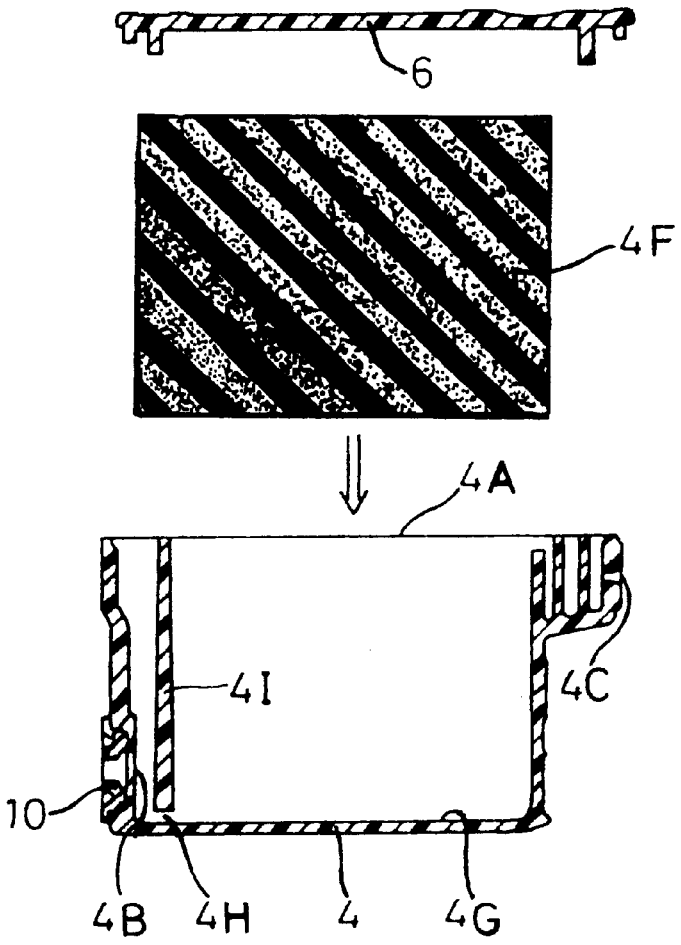

FIGS. 3A and 3B show a portion of the manufacturing process of the ink cartridge 2. FIG. 3A is a vertical cross-sectional view taken from one side of the cartridge case 4, and FIG. 3B is a vertical cross-sectional view taken from a side perpendicular to the side shown in FIG. 3A. First, a porous material 4F is compressed and inserted into the foam chamber 4G via the opening 4A formed in the top wall of the cartridge case 4. Then, the lid 6 is welded to the cartridge case 4. After that, degassed ink is injected into the ink chamber 4E from the ink-supply hole 4B by an ink injector (not shown).

Prior to injecting the ink, the ink injector is connected to the ink-supply hole 4B, while a vacuum is applied to the air hole 4C via a vacuum generating device (not shown) to reduce the pressure inside the ink cartridge 2.

When the inside pressure reaches a predetermined value (for example, −710 mmHg assuming that 1 atmosphere of pressure is 0 mmHg), ink injection is started.

Because the air is evacuated from the ink cartridge 2 in advance, the ink is easily sucked into the ink chamber 4E. The ink first contacts the partition 4I that separates the ink chamber 4E and the foam chamber 4G, and fills the ink chamber 4E. Then, the ink flows into the foam chamber 4G through the hole 4H, and is absorbed in the porous material 4F.

Finally, a long sealing tape 12 is thermally adhered to the cartridge case 4 and the lid 6 so as to completely seal up the ink-supply hole 4B and the air hole 4C. One end 12A of the sealing tape 12 is thermal-adhered to the bottom 4J of the cartridge case 4 near the ink-supply hole 4B, while the other end 12B of the sealing tape 12 is left free, so that the user can peal off the sealing tape 12 from this portion when the cartridge is actually used.

Figure 4:
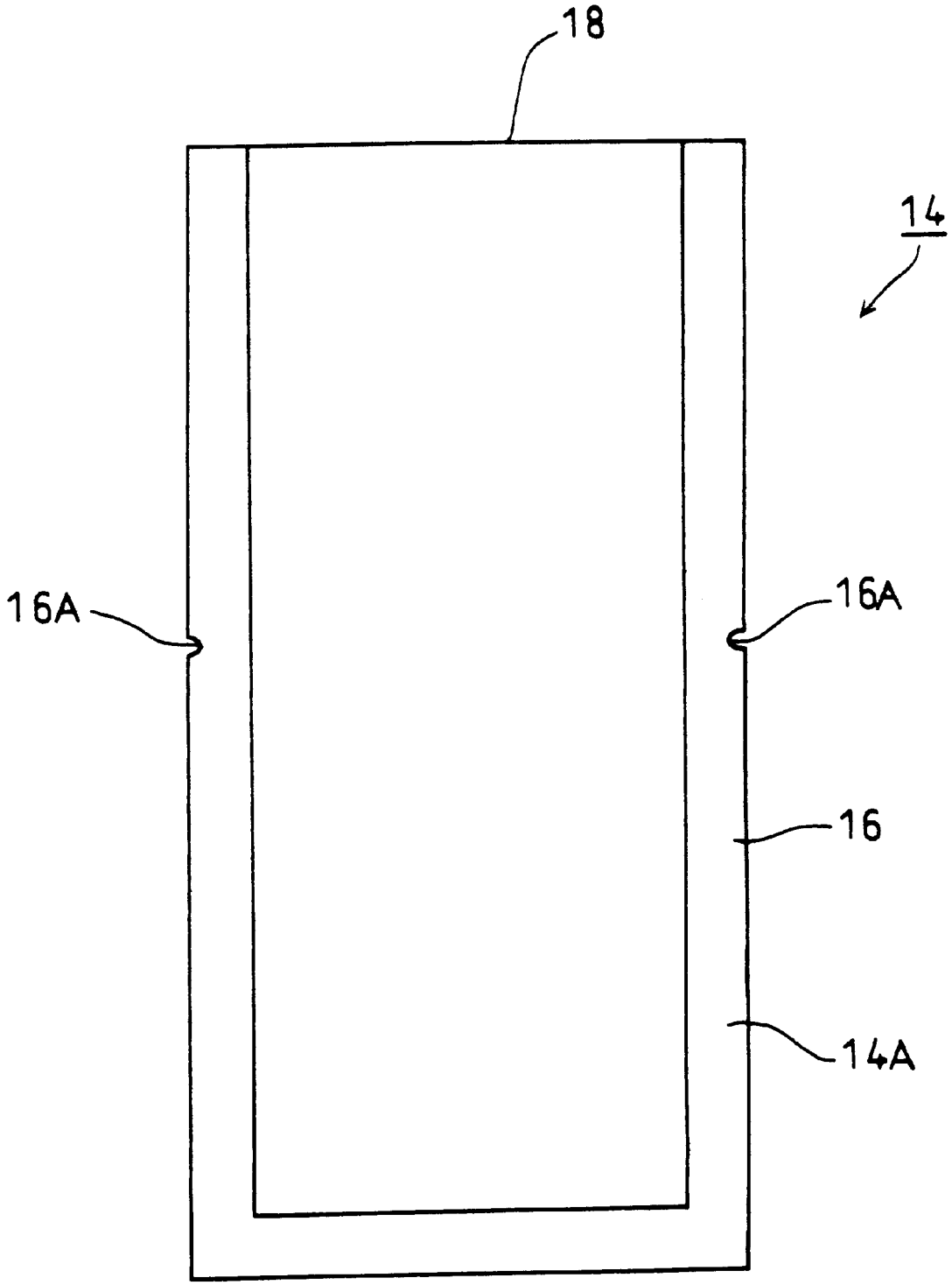
FIG. 4 is a plan view of a packaging bag according to an embodiment of the invention.
Figure 5:
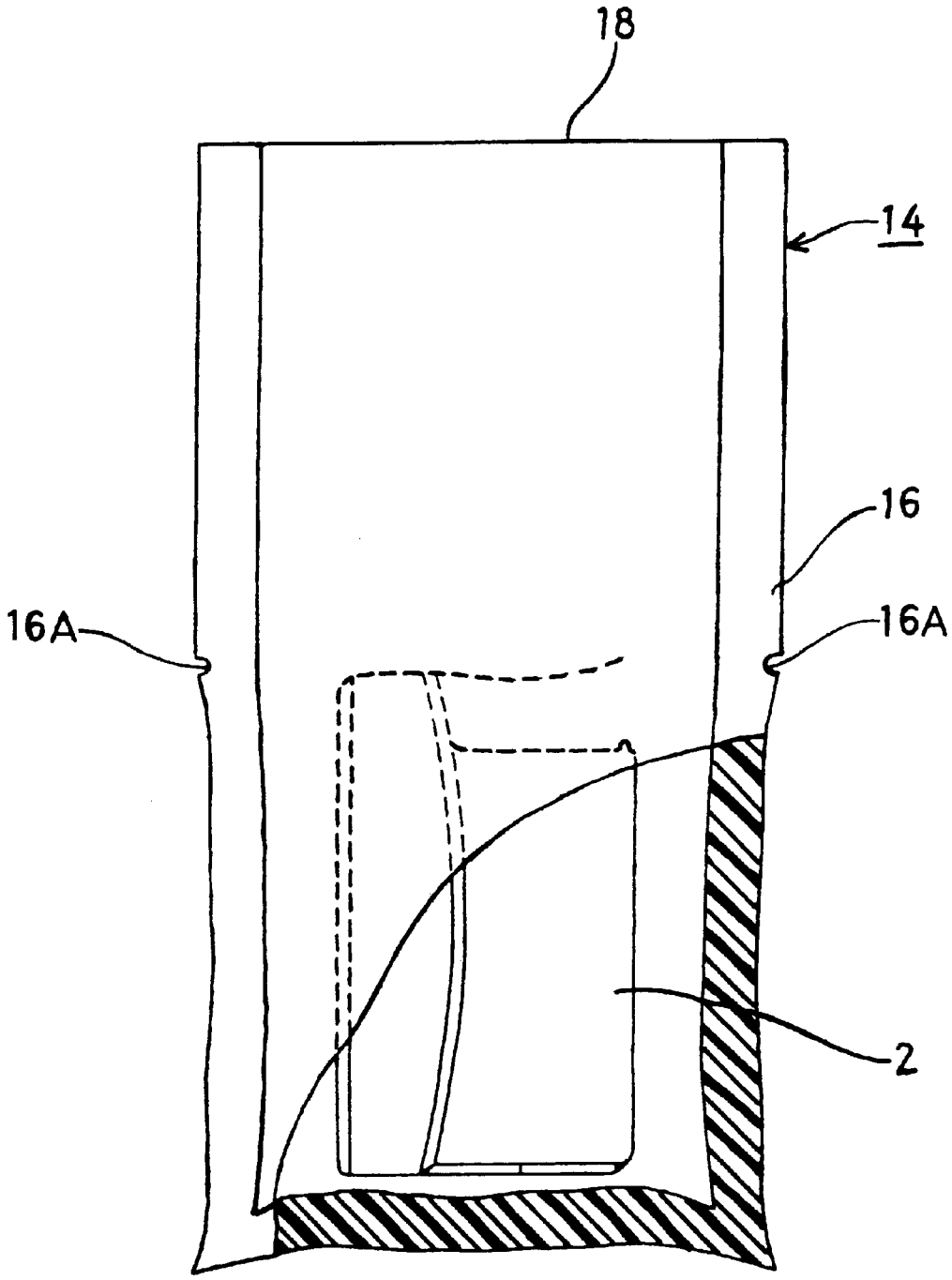
FIG. 5 illustrates how the ink cartridge is packed in the packaging bag.

FIG. 4 illustrates a packaging bag 14 made of aluminum laminate sheet. The ink cartridge 2 is packed in the packaging bag 14. The packaging bag 14 is made from two sheets of rectangular aluminum sheets. The two sheets are aligned with each other, and three edges 14A of the rectangular sheets are thermally sealed. Thus, sealed edges 16 surround the packaging bag 14. One edge is left unsealed as an open edge 18, through which the ink cartridge 2 is inserted into the packaging bag 14, as shown in FIG. 5.

Figure 6:
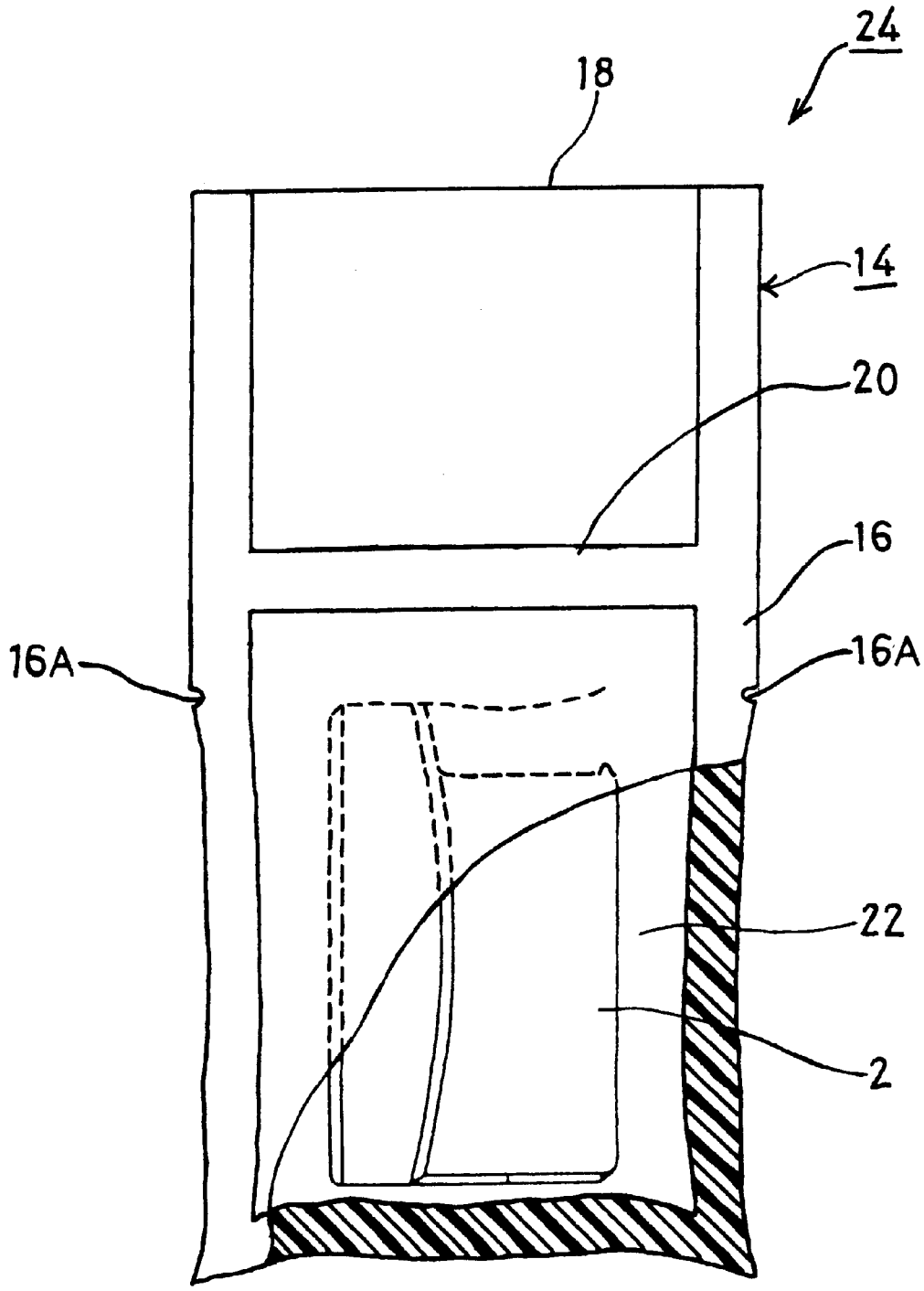
FIG. 6 illustrates how a plurality of ink cartridges are packed into a series of packaging bags.

The open edge 18 is inserted into a thermal-sealing box to seal up the packaging bag 14. Prior to the thermal sealing, the pressure inside the sealing box is adjusted to a predetermined value. After the thermal sealing, an adhered boundary 20, i.e., a sealed portion, is formed and the four sides of the packaging bag 14 are sealed up, as shown in FIG. 6. One or more notches 16A are formed on either or alternatively both sides of the sealed packaging bag, so that the user can open the packaging bag easily. Then, the user peals off the sealing tape 12, and sets the ink cartridge 2 in the ink-jet printer.

A package chamber 22 is formed in the packaging bag 14 after the thermal sealing, in which an ink cartridge 2 is accommodated. In general, the ink-cartridge package 24 comprises the package chambers 22 separated by the adhered boundary 20, as shown in FIG. 6. The ink-cartridge package 24 is folded and stored in a case or box for shipping and transportation.

The pressure inside the thermal-sealing box is adjusted to a predetermined value prior to the thermal sealing. If the volume of the ink cartridge 2 is Vi, and the maximum packaging volume of the package chamber 22 is Vmax, then Vmax does not exceed twice the value of Vi (Vmax 2Vi). In other words, the maximum volume Vmax of the packaging chamber 22 must be smaller than or equal to 200% of the volume Vi of the ink cartridge 2. Preferably, Vmax is 140% to 160% of Vi.

If the maximum packaging volume Vmax is below 140% of the volume of the ink cartridge, the packaging bag cannot contain a sufficient amount of air to absorb shocks. If the maximum packaging volume Vmax exceeds 160% of the volume of the ink cartridge, the packaging volume is too large as compared with the volume of the ink cartridge to be packed, and the surface of the packaging bag is likely to lose tension and thus be unable to form an air cushion between the ink cartridge and the packaging bag.

The volume of the package chamber 22, which is formed after the packaging bag 14 is thermally sealed up with the ink cartridge 2 packed therein, is substantially constant under an arbitrary pressure Pr. This volume is indicated as Vr.

If the volume of the air gap between the packaging bag 14 and the ink cartridge 2, which is defined after the packaging bag is thermally sealed and taken out of the sealing box and into the atmosphere at room temperature, is V1, and if the atmospheric pressure is $P_0$ (i.e., 1 atm), then V1 is expressed as:

$$V1=(Vr-Vi)\times(Pr/P_0). \quad (1)$$

The ratio S(%) of V1 (i.e., the volume of the air gap) to Vr (i.e., the volume of the ink cartridge) is expressed as:

$$S=(V1/Vi)\times 100=[(Vr/Vi)-1]\times(Pr/P_0)\times 100. \quad (2)$$

In this embodiment, the pressure Pr inside the sealing box is adjusted so that the ratio S is 10% to 30%.

Since the volumes Vr and Vi do not vary much among products, the pressure Pr inside the sealing box is set at the beginning of the packaging process so that S is 10% to 30%, and this pressure value can be maintained simply throughout the packaging process. It is not necessary to adjust the pressure for each packaging bag 14 of the ink-cartridge package 24.

[Dropping Test]

Ten (10) ink-cartridge packages 24, each containing an ink cartridge 2 with an air gap of 10% to 30% of the volume of the ink cartridge 2, were used in a dropping test. The ink-cartridge packages 24 were dropped from a height of 90 cm. Cracks and breakage of the ink cartridges 2, as well as tearing of the packaging bags 14, were checked. Then, as a comparison test, the same packages 24, but having an air gap of less than 10% of the volume of the ink cartridge 2, were dropped from the same height. The test results are shown in FIG. 7.

As is clear from the table of FIG. 7, with the air gap of 10% to 30% of the volume of the ink cartridge 2, cracks or breakage caused by the falling impact was greatly reduced, even without a shock absorber inserted in the packaging bag, because the air gap operates effectively as an air cushion. With this amount of air, the package 24 is easily folded at the boundaries 20.

If the value of S (i.e., the ratio of the volume of the air gap to the volume of the ink cartridge 2) exceeds 30%, the ink cartridge 2 was apt to move within the packaging chamber 22, and cracks and breakage slightly increased. In addition, the packaging bag 14 was likely to burst due to the falling impact. However, this result was better than when the range was less than 10%. With too much air, the package 24 cannot be folded at the boundaries 20. This creates problems in shipping and transportation.

In conclusion, it is preferable to set the maximum volume of the package chamber 22 to be less than or equal to 200% of the volume of the ink cartridge 2. The most preferred range of the maximum packaging volume of the packaging bag 14 is 140% to 160% of the volume of the ink cartridge 2. At the same time, it is preferable to set the volume of the air layer between the ink cartridge 2 and the packaging bag 14 to 10% to 30% of the volume of the ink cartridge 2.

Unlike conventional vacuum packing, the appropriate amount of air is contained in the packaging bag 14, and the ink cartridge 2 packed in the packaging bag 14 is protected by the air layer from impacts, even if no shock absorbing material is stuffed into the packaging bag 14.

In addition, the ink-cartridge package 24 can be easily folded for shipping and transportation.

Figure 8:
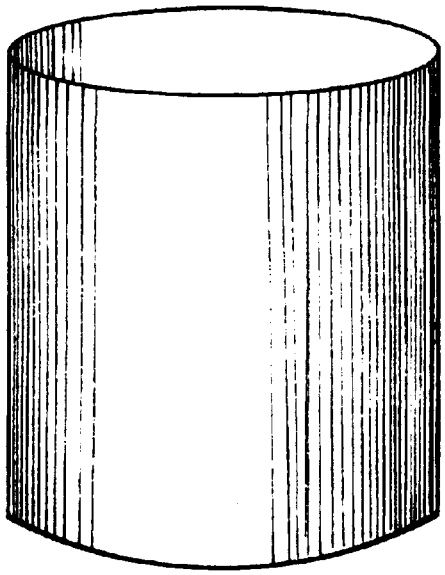
FIG. 8 is a perspective view of a packaging bag according to another embodiment of the invention.
Figure 9:
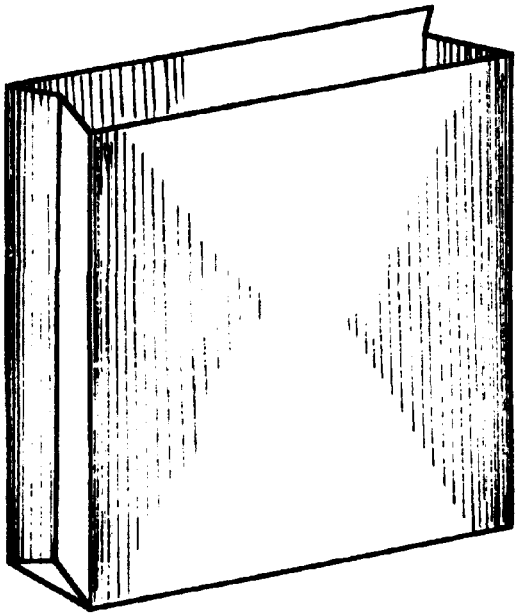
FIG. 9 is a perspective view of a packaging bag according to still another embodiment of the invention.

The shape of the packaging bag 14 is not limited to a flat rectangle with the edges 14A thermally sealed. The packaging bag 14 may be a cylindrical pillow case, as shown in FIG. 8, or a gusset bag having a gore, as shown in FIG. 9. These types of packaging bags achieve the same effect as the packaging bag 14 illustrated in the embodiment described above.

It should be understood that many changes and substitutions may be made by those skilled in the art without departing from the spirit and the scope of the invention.

What is claimed is:

1. An ink-cartridge package, comprising:

an ink cartridge having a cartridge case and ink disposed in the cartridge case; and a packaging bag housing the ink cartridge, such that a maximum packaging volume of the packaging bag is 140% to 160% of a volume of the ink cartridge, and a volume of gas equal to at least 10% of the volume of the ink cartridge is disposed in the packaging bag, the packaging bag being sealed such that the volume of gas operates as a gaseous cushion with regard to the ink cartridge housed in the packaging bag.

2. The ink-cartridge package according to claim 1, wherein the volume of gas disposed in the packaging bag is 10% to 30% of the volume of the ink cartridge housed in the packaging bag.

3. The ink-cartridge package according to claim 2, wherein the packaging bag is formed by thermally sealing edges of a sheet.

4. The ink-cartridge package according to claim 3, wherein the packaging bag is made of aluminum laminate.

5. The ink-cartridge package according to claim 2, wherein the packaging bag is a cylindrical pillow case.

6. The ink-cartridge package according to claim 2, wherein the packaging bag is a gusset bag having a gore.

7. The ink-cartridge package according to claim 2, wherein the ink cartridge is used in ink-jet printers.

8. The ink-cartridge package according to claim 2, wherein the thermally sealed edges define a notch for opening the bag.

9. The ink-cartridge package according to claim 1, wherein the gas is air.

10. The ink-cartridge package according to claim 1, wherein the packaging bag includes two rectangular sheets that are aligned relative to each other, and edges of the two sheets are thermally sealed together.

11. The ink-cartridge package according to claim 1, wherein the ink-cartridge package is manufactured using a thermal sealing box, and the packaging bag is thermally sealed in the thermal-sealing box under the following condition:

$$10\leqq[(Vr/Vi)-1]\times(Pr/Po)\times 100\leqq 30,$$

where Vr is a packaging volume of the packaging bag, Vi is a volume of the ink cartridge to be housed in the packaging bag, Pr is a pressure within the thermal sealing box, and Po is atmospheric pressure.

* * * * *